United States Patent [19]

Kelland

[11] Patent Number: 4,678,478

[45] Date of Patent: Jul. 7, 1987

[54] METHOD FOR DESULFURIZATION OF COAL

[75] Inventor: David R. Kelland, Lexington, Mass.

[73] Assignee: Massachusetts Institute of Technology, Cambridge, Mass.

[21] Appl. No.: 851,924

[22] Filed: Apr. 14, 1986

[51] Int. Cl.[4] ..... C10L 9/00; C10L 9/04

[52] U.S. Cl. ..... 44/1 SR; 201/17

[58] Field of Search ..... 44/1 SR; 201/17

[56] References Cited

U.S. PATENT DOCUMENTS

| | | | |
|---|---|---|---|
| 4,052,170 | 10/1977 | Yan | 44/1 SR |
| 4,119,410 | 10/1978 | Kindig et al. | 44/1 SR |
| 4,148,614 | 4/1979 | Kirkbride | 44/1 SR |
| 4,152,120 | 5/1979 | Zavitsanos et al. | 44/1 SR |
| 4,545,879 | 10/1985 | Wan et al. | 44/1 SR |
| 4,597,769 | 7/1986 | Attar | 44/1 SR |

OTHER PUBLICATIONS

*Mineral Matters,* C. C. Hinckley, et al., vol. 7, No. 3, May 1985.

"Magnetic Separation and Thermo-Magneto-Chemical Properties of *Coal Liquefaction Mineral Particulates*", Maxwell et al., *GE Technical Information Series Report,* No. 80CRD162, Jul. 1980.

*Primary Examiner*—Carl F. Dees

*Attorney, Agent, or Firm*—Hamilton, Brook, Smith & Reynolds

[57] ABSTRACT

A process and apparatus for desulfurizing coal which removes sulfur in the inorganic and organic form by preferentially heating the inorganic iron sulfides in coal in a flowing gas to convert some of the inorganic iron sulfides from a pyrite form $FeS_2$ to a troilite FeS form or a pyrrhotite form $Fe_{1-x}S$ and release some of the sulfur as a gaseous compound. The troilite and pyrrhotite forms are convenient catalyst for removing the organic sulfur in the next step, which is to react the coal with chemical agents such as alcohol, thus removing the organic sulfur as a liquid or a gas such as $H_2S$. The remaining inorganic sulfur is left in the predominantly higher magnetic form of pyrrhotite and is then removed by magnetic separation techniques. Optionally, an organic flocculant may be added after the organic sulfur has been removed and before magnetic separation. The flocculant attaches non-pyrite minerals with the pyrrhotite for removal by magnetic separation to reduce the ash-forming contents.

16 Claims, 2 Drawing Figures

Velocity dependance of ash and sulfur reduction. $C_o/C_i$ is the ratio of ash or inorganic sulfur in the product to that in the feed.

METHOD FOR DESULFURIZATION OF COAL

GOVERNMENT SPONSORSHIP

The Government has rights in this invention pursuant to Grant No. DE-FG02-84ER13244 awarded by Department of Energy.

TECHNICAL FIELD

This invention is in the field of coal desulfurization and the removal of ash-forming minerals from the coal.

BACKGROUND OF THE INVENTION

The present invention relates to a relatively inexpensive method and apparatus for coal desulfurization and de-ashing in which both the inorganic (pyrite) and organic sulfur is removed from coal along with removal of ash-forming minerals.

The cost of fuel oil as an energy source and its predicted depletion as well as the dependence on foreign sources makes the use of other type fossil fuels as fuel oil substitutes attractive. The abundance of coal in the United States and its accessibility suggests immediate direct substitution of coal for fuel oil where possible. An important factor limiting the substitution of coal for fuel oil is the effect of the by-products of coal burning on the ecology, particularly the sulfur by-products.

Untreated coal comprises organic carbonaceous material and inorganic minerals. Sulfur occurs in coal both in organic and inorganic forms. In the organic forms, the sulfur is chemically bonded into the hydrocarbon structure of the coal and generally cannot be removed by physical means such as magnetic separation. The inorganic forms of sulfur, generally occurs as pyrite, $FeS_2$, but also includes other iron sulfur inorganics such as pyrrhotite $Fe_{1-x}S$, and occurs as iron sulfide mineral inclusions in the coal and, therefore, can be removed magnetically. The relative proportions of organic and inorganic sulfur in coal vary with the source of the coal. In many coals from the Eastern half of the United States, the proportions are approximately equal.

Several techniques have been developed for removing sulfur from coal. Physical techniques, such as magnetic separation, are used to remove the inorganic sulfur. Chemical techniques, such as reacting coal with carbon disulfide, are used to remove the organic, as well as some of the inorganic sulfur. Thermo-chemical reactions can be caused by irradiating the coal aggregate with microwave energy to break bonds uniting organic coal components and sulfur contained in the coal aggregates (See Zavitsanos et al., U.S. Pat. No. 4,076,607). Chemical processes, such as reacting coal with carbon disulfide, are expensive since they generally involve the use of expensive chemicals. Using chemicals to remove the inorganic sulfur along with the organic sulfur is usually a much more expensive process than to use a physical method for inorganic desulfurization. Thermochemical processes using microwave heating along with numerous repeated processing steps with sodium hydroxide (caustic soda) are complex and still very expensive.

Purely physical processes for removal of the inorganic sulfur usually lose effectiveness when they encounter very small mineral particle sizes. This is particularly true for surface dependent techniques such as flotation or oil-water phase separation. These, as well as magnetic separation techniques do not address the problem of organic sulfur removal. In the application of the latter process, difficulty is encountered in separating weakly paramagnetic pyrite from the coal and the process is often ineffective in removing the non-pyritic ash-forming minerals.

For any physical separation, the coal must be crushed to liberate the mineral particles. Imperfect liberation leaves some coal associated with the minerals and even if these mixed particles are completely separated from the coal, some coal is lost. Excellent liberation is achieved by liquefying the coal to overcome the limitations of crushing and grinding but the liquefaction is accomplished at high temperature and pressure which; while it can alter the mineral magnetic properties to make magnetic separation more effective, nevertheless, it remains an expensive route to clean coal fuels. Such efforts have been largely abandoned in the United States because of cost. Magnetic methods of mineral removal from coal depend on the difference in the magnetic moment associated with mineral particles and that of coal. Coal is generally diamagnetic while some minerals are paramagnetic or have even stronger magnetic properties. As high grade coals have become scarce, coals used for steam generation often contain very fine mineral impurities making liberation difficult and expensive. In addition, magnetic properties are smaller for small particles. This can be overcome to some extent by altering those properties.

The approaches to magnetic coal cleaning can be divided into two categories relevant to the present invention: direct desulfurization and deashing, and separating coal minerals which have had pretreatment to enhance their magnetic properties.

The first, direct desulfurization has been carried out on crushed coal in water, oils, alcohol and in air or inert gas. The "direct" process depends on the difference between the magnetic properties of coal and those of its associated mineral impurities as found.

The second approach, enhancement of the magnetism of included coal minerals has been attempted by several methods: heating the whole coal, microwave irradiation to selectively heat the minerals, depositing iron selectively on the minerals from iron carbonyl (J. K. Kindig, The Magnex Process: Review and Current Status, Proceedings of the Conference on Industrial Applications of Magnetic Separation, Rindge, N. H. July 30–Aug. 4 1978, *IEEE Publ. No.* 78 *CH*1447-2 *Mag.*) and by adjustment of the atmosphere in an autoclave containing liquefied coal. Some of these efforts have had as their objective to improve desulfurization by HGMS and some to make other conventional magnetic separations more effective. (D. Kelland, "A Review of HGMS Methods of Coal Cleaning" *IEEE Transactions on Magnetics* Vol. MAG-18 No 3 May 1982)

As taught by Maxwell et.al in U.S. Pat. No. 4,466,362, issued Aug. 21, 1984, the success of magnetic separation is enhanced by the conversion of nonmagnetic, or weakly magnetic iron sulfides, to highly magnetic monoclinic pyrrhotite. Pyrrhotite is a nonstoichiometric compound with the approximate composition $Fe_{0.9}S$ occurring in two crystalline forms: hexagonal pyrrhotite and monoclinic pyrrhotite. The monoclinic form is much more strongly magnetic than the hexagonal form but occurs only in a narrow range of compositions in the neighborhood of 47 atomic percent of iron. At 220° C. conversion from the hexagonal to the monoclinic state is favored-and takes place rapidly; see "The Structure and Properties of Some Iron Sulphides", *Reviews of Pure and Applied Chemistry,* Vol. 20, p. 175, 1970.

In naturally occurring coal, sulfur appears mostly in the form of pyrites $FeS_2$, which is only marginally paramagnetic. But, there are also small amounts of pyrrhotite present in the pyrite particles through the conversion of pyrite to pyrrhotite in nature and through heating during the subsequent grinding of the coal to form the necessary small particles for magnetic processing. These sulfides occur as interlocked particles differing in crystalline structure. For maximum efficiency in HGMS, the pyrrhotite inclusions in the pyrite should be in the more magnetic monoclinic state so that magnetic separation will be more complete.

Despite the intensive on-going investigations and experimentation in the field of coal desulfurization, a need still exists for a low cost desulfurization process which is effective in removing both the organic and inorganic sulfur.

DISCLOSURE OF THE INVENTION

The invention comprises a desulfurization method and apparatus for removing both the inorganic and organic sulfur from coal. The invention involves a combination of physical, chemical, and simple thermo-chemical cleaning steps to remove both kinds of sulfur. A further, optional process, is described for removal of non-pyritic ash-forming minerals from the residue of the desulfurization process.

The desulfurization process of the invention commences with coal as the starting material. The coal contains minerals, inorganic sulfur in the form of pyrites and organically bound sulfur in the hydrocarbon structure. In the first step of the process, microwave radiation is applied to the coal to preferentially heat the pyrite ($FeS_2$) driving off some of the sulfur from the pyrite as gaseous $H_2S$, $SO_2$, COS, etc. Assuming that half of the sulfur is removed from the pyrite in this step it is left as troilite (FeS). If half is not removed, pyrrhotite ($Fe_{1-x}S$) is formed. A flowing gas, such as argon, carbon monoxide or hydrogen, is used in this step to prevent the sulfur from re-combining with the coal.

Next, a hydrogenation agent in the form of a liquid hydrocarbon, such as an alcohol, like ethanol, is used to remove the organic sulfur in the presence of a catalyst. Conveniently, the troilite formed in the microwave heating step is an excellent catalyst for breaking thiophene and also thiol sulfur bonds, which bond the organic sulfur in the carbonaceous part of the coal. Alternatively, the pyrrhotite formed in the preferential heating step is also a catalyst for thiol sulfur. This organic sulfur is removed as $H_2S$, and some of it causes a shift in the stoichiometry of the troilite toward pyrrhotite. This step leaves clean coal i.e., organic sulfur removed and highly magnetic pyrrhotite (inorganic sulfur).

Lastly, magnetic separation, such as high gradient magnetic separation (HGMS), is used to remove the remaining inorganic sulfur; most of which is now in the highly magnetic form of monoclinic pyrrhotite, $Fe_7S_8$.

Optionally, after the organic sulfur has been removed and before magnetic separation takes place, non-pyrite ash-forming minerals remaining in the coal may be treated by an organic flocculant, such as Tergitol 7 (sodium heptadecyl sulphate) while adjusting the magnetization of the pyrite with $H_2S$. The flocculant, serves to attach the non-pyrite minerals present in the residue with the pyrrhotite for removal together by magnetic separation in the final step so as to significantly reduce the ash in addition to the organic and inorganic sulfur already removed; thereby resulting in a superclean coal product.

BEST MODE OF CARRYING OUT THE INVENTION

A detailed description of a preferred embodiment of the invention will now be described in connection with FIG. 1. As may be seen therein, untreated, pulverized coal is contained in a suitable microwave cavity or chamber. (Block 12 FIG. 1)

STEP 1: PREFERENTIAL HEATING

In the first step of the process (Block 14) the coal is subjected to microwave radiation for the purpose of preferentially heating the pyrite ($FeS_2$) to transform the inorganic sulfur material in the coal to a more highly magnetic state and to extract some of the sulfur by thermo-chemical reactions. The microwave heat source should have enough power to heat the pyrite to a sufficient temperature to shift the stoichiometry (Fe-S ratio) away from $FeS_2$ towards $Fe_{1-x}S$; wherein 0 is less than or equal to x, and x is less than or equal to 0.5. Preferential heating, preferably by microwave energy, is economically advisable, in order to avoid heating the coal rather than the pyrite because energy used to heat the coal is wasted unless it is fully recovered. Heating the whole coal would require a far larger, and hence, more expensive, energy source. Also, preferential heating to increase magnetization is advantageous because no dangerous chemicals like carbon monoxide are produced as is the case in the process of J. K Kindig supra, where iron is deposited on the pyrite from $Fe(Co)_5$. Furthermore, no high pressures are needed; hence no high pressure vessels are required.

Figure 1:
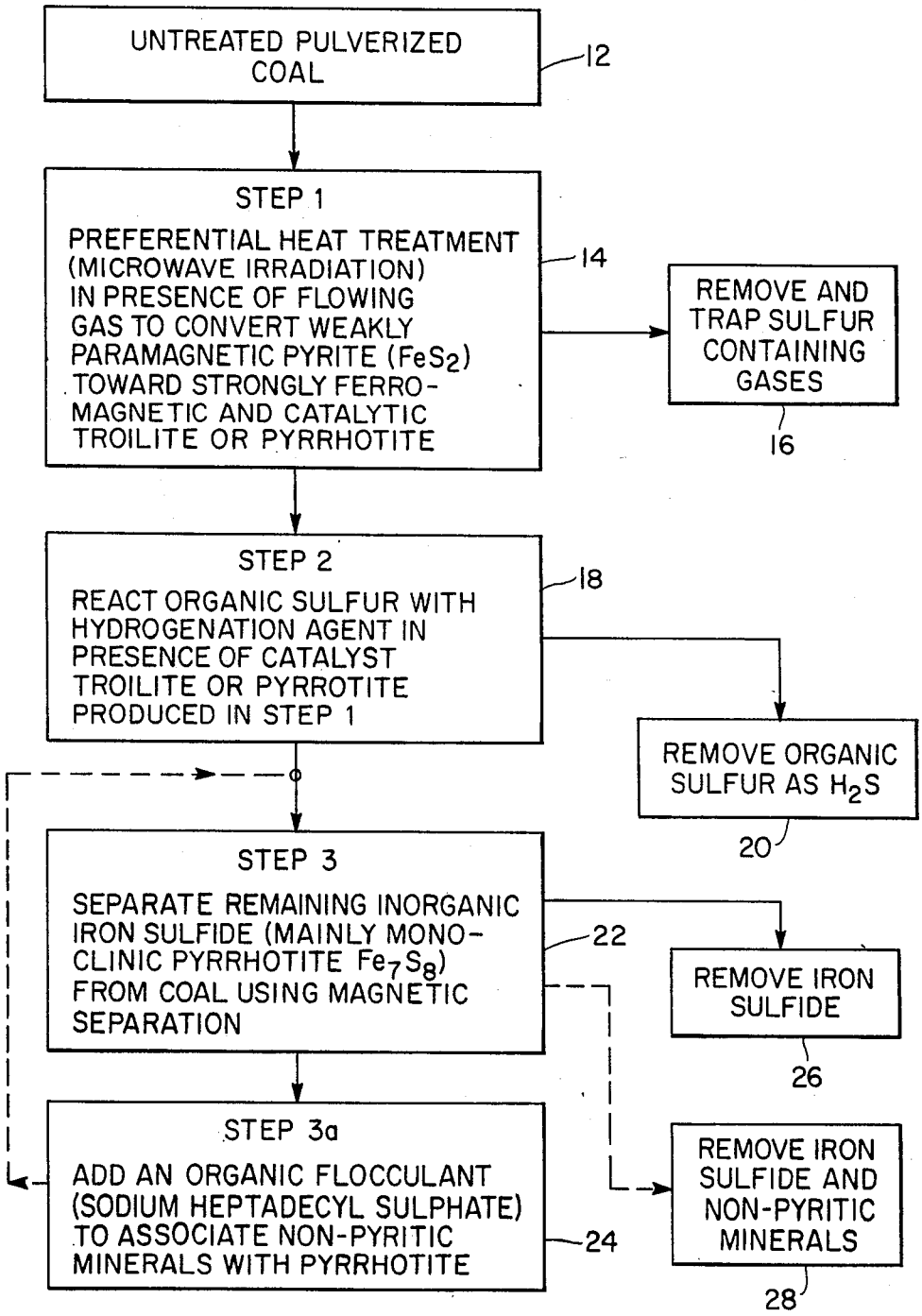
FIG. 1 is a block diagram of a process for coal desulfurization in accordance with the invention.

In the process of preferentially heating the pyrite some of the sulfur is driven off from the pyrite as gaseous sulfur, such as $H_2S$, $SO_2$, COS, and is removed and trapped as indicated in block 16 of FIG. 1. With sufficient preferential heating of the pyrite some of the pyrite is converted to $Fe_7S_8$ i.e., $Fe_{1-x}S$ with $x=0.125$ which is monoclinic pyrrhotite. Monoclinic pyrrhotite is highly magnetic and equally importantly is strongly catalytic and can be used for breaking sulfur bonds to release the organic sulfur. Furthermore, this shift, in and of itself, represents a reduction in the total sulfur content of the coal. We have found that to minimize the amount of energy used in preferential heating the pyrite, the time for heating the pyrite must be kept short, i.e. between about 1 minute, and 10 seconds. For a one minute treatment, the magnetization increases sharply upward from less than 0.1 cgs emu/gm at 9 k0e applied field to 4.5 emu/gm in a temperature range from 675 C. to 740 C. For 10 seconds, the magnetization increases from 0 at 665 C. to about 0.5 emu/gm at 760 C. Experimental data indicates that the same magnetization of 4 or 5 emu/gm would be reached at slightly over 800 C. for the 10 second heating time. Considering that the magnetization at 9 k0e of pure monoclinic pyrrhotite, $Fe_7S_8$, is about 17 emu/gm, these resulting magnetization levels represent a significant conversion of pyrite to pyrrhotite. Only a few percent of a pyrite particle needs to be converted to render it orders of magnitude more magnetic.

To confirm that the increase in magnetization is due to pyrrhotite, Mossbauer measurements of the crystal structure environment for Fe were made and show that the iron is clearly in the form of an ordered (monoclinic) pyrrhotite. Coal samples used to obtain this experimental data were about half a gram and were heated under pure argon. In a full scale process, inert gas, or the naturally reducing atmosphere of heated coal, CO+. . . , would prevent complete oxidation of the pyrite to $Fe_2O_3$ or iron metal. However, even oxidation would be still be suitable for enhancing the potential magnetic separation results since both of these forms are more magnetic than pyrite. Microwave heating experiments on Illinois #6 coal have produced all of these forms in air; and enhancement of magnetic separation results have been recorded using 30 gram samples.

As stated above, sulfur is released as various gasses; $H_2S$, COS, and $SO_2$. Where the sulfur in pyrite combines with bound hydrogen to form $H_2S$, the reaction has the form:

$$(1-x)FeS_2+(1-2x)H_2 \rightarrow Fe_{1-x}S+(1-2x)H_2S$$

The sulfur can also combine with the organic coal structure. To prevent this, a flowing gas stream is recommended during Step 1. This gas may comprise the hydrogen needed for the above reaction.

In Step 1, if half of the total sulfur in the coal were in the inorganic mineral form of $FeS_2$ to begin with, then roughly one-quarter of the total sulfur would be removed as the pyrite undergoes a transition to $Fe_7S_8$ (nearly FeS), provided none of it combines with the organic coal structure. It should be noted, that in practice it is difficult to control which compound or mixture is produced, especially in a coal preparation plant. Generally, only part of each pyrite particle is converted, so we must assume that a mixture will result. Troilite appears to be favored if a flowing gas is used to prevent recombination of the sulfur coming off the pyrite with the organic coal structure.

STEP 2: CATALYTIC REACTION WITH HYDROGENATION AGENT

In the next step of the process, Step 2 (Block 18), the irradiated coal, which has been magnetically enhanced, is treated with a light organic hydrocarbon liquid, such as ethanol, methanol, or light fractions from coal hydrolysis, in the presence of the catalytic material, i.e., pyrrhotite or troilite produced by the enhancement in Step 1. This results in the removal of the organic sulfur as $H_2S$, in accordance with the following chemical process:

$$FeS_2+C_2H_5OH \rightarrow CH_3CHO+H_2S+\sim FeS:$$

where ~FeS is troilite and/or pyrrhotite.

Chemical approaches for removal of inorganic sulfur from coal have been known to take several hours while some of the alkali or caustic soda processes can effect considerable organic sulfur removal in under an hour. Experiments with ethanol and coal in an autoclave in which the ethanol was replaced several times during heating from 350° C. to 550° C. and held for one-half hour at 550° C. and then an additional 3.5 hours showed considerable effects of temperature and sample size. [C. C. Hinckley, et al., *MINERAL MATTERS,* Vol. 7, No. 3 May 1985] Also, the conversion of pyrite to troilite by reaction under carbon monoxide takes several hours. Thus, by replacing the pyrite to troilite reaction by a preferential heating process, which requires a time of about one minute, the total process time and the cost is vastly reduced.

STEP 3: MAGNETIC TREATMENT

The next step of the process is shown in block 22 and labelled Step 3. In Step 3, the remaining inorganic iron sulfides are separated from the coal using well known magnetic separation techniques. Prior to this step, the organic sulfur has been removed from the coal and the coal and iron sulfide is suspended in an alcohol mixture. Experimental data indicates that magnetic separation in alcohol is somewhat preferable to that in water. In Step 3 the remaining approximately one-quarter of the sulfur is removed by magnetic separation as $Fe_{1-x}S$. The troilite which was essential for the breaking of the thiophenic sulfur bond in Step 2 will be at least partially converted to pyrrhotite during the chemical desulfurization step. Since pyrrhotite and especially monoclinic pyrrhotite $Fe_7S_8$ is highly ferromagnetic; it is an ideal candidate for magnetic separation and will result in a substantial savings in cost and process complexity by avoiding the necessity in prior art magnetic processes of oxidizing the iron sulfide form to magnetite or hematite to achieve the requisite magnetic strength for efficient separation. It is contemplated that the separation in Step 3 would be carried out on a stream of coal coming from the reactor of Step 2 at approximately 1000 tons per hour. In such case, the magnetic field may be less than about 2 Teslas (20 kOe), which is in the range of iron core copper coil magnets. Alternatively, superconducting magnets could be used in this field range to save power costs.

It is believed that the power to generate the microwave energy for preferential heating would represent about 1% of the heating value of the coal while the power to operate the magnetic separator would be about 1% to 2% so that the total operating cost for power stated as a percentage of the heating value of the coal should not exceed 3% in accordance with the invention.

STEP 3(a): OPTIONAL FLOCCULANT ASSOCIATION

Alternative Step 3(a) (Block 24), as indicated by the dotted lines, may be utilized to remove the non-pyritic ash-forming minerals remaining after Step 2. In the present process, the second step of organic desulfurization ends with a desulfurized "char" in the residual alcohol. Addition of a flocculant, such as Tergitol 7, (sodium heptadecyl sulphate) at this point, as described in Step 3(a), associates the non-pyritic minerals with the pyrrhotite for removal by magnetic separation.

Magnetic separation experiments were performed in a seperate project reported in *GE Technical Information Series Report* No. 80CRD162, July 1980 by E. Maxwell, et al. Relevant data from these tests is summarized in Table I below. A one gallon autoclave was partially filled with SRC (solvent refined coal) i.e. coal dissolved in an organic solvent (derived from the coal itself) and then hydrogenated. The combined atmosphere of $H_2/H_2S$ in the autoclave could be adjusted. A recirculating loop (V=51 cm/s to 154 cm/s) kept the flocs in suspension but not broken. Without $H_2S$ (runs 1–4) the non-Fe ash was reduced to 5.7% (avg. 3 runs) and 11%.

With $H_2S$ alone (runs 5–6), the reduction was 12.7% and 16.9%. With Tergitol alone (runs 9–10), the reduction was 13.9% and 17.2%, and with both $H_2S$ and Tergitol (runs 7–8), 28.3% and 29.1%. Thus, by adjusting the magnetization of the pyrite by adjusting the $H_2/H_2S$ ratio and then associating the ash minerals with the resulting pyrrhotite by using an organic flocculant, such as Tergitol, the ash can be reduced significantly as the inorganic sulfur is removed by HGMS (Block 28, FIG. 1).

It is interesting to note from the above experiments that in all cases, more ash is removed than that which can merely be accounted for as simply $Fe_2O_3$. It is known that some of the non-iron-bearing minerals are paramagnetic and should come out, but it is also likely that many of the pyrrhotite particles are locked with other mineral particles and the composites come out together.

TABLE I

| Run # | % Reduction of Non-Fe Ash |
|---|---|
| 1 | 11.0 |
| 2 | 5.8 |
| 3 | 5.7 |
| 4 | 5.6 |
| 5 | 16.9 |
| 6 | 12.7 |
| 7 | 29.1 |
| 8 | 28.3 |
| 9 | 13.9 |
| 10 | 17.2 |

Figure 2:
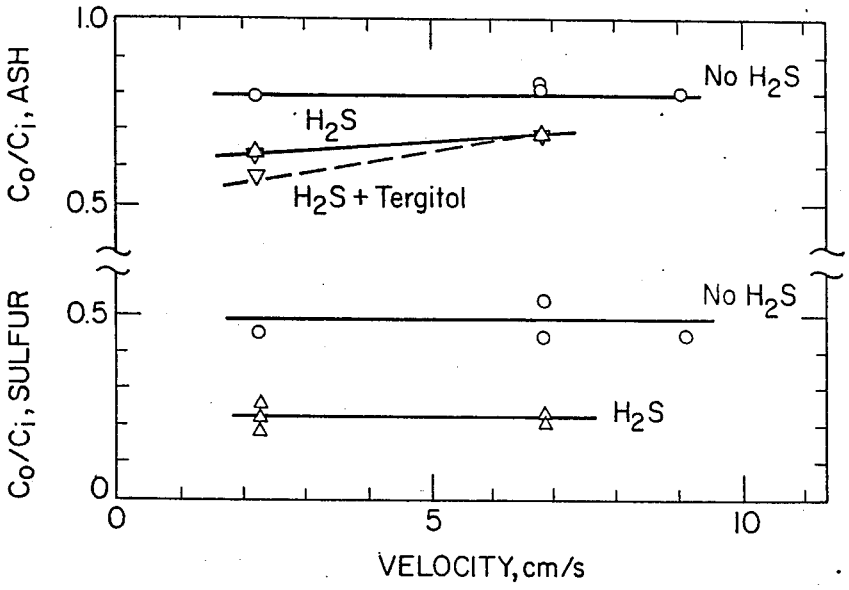
FIG. 2 is a plot of the velocity dependence of ash and sulfur reduction.

NOTES:
Runs 1–4 no additions to autoclave
Runs 5–6 $H_2S$ added alone
Runs 7–8 $H_2S$ + Tergitol added
Runs 9–10 Tergitol added alone The velocity dependence of the ash and sulfur reduction is shown graphically in FIG. 2. FIG. 2 is a plot of the ratio of ash and sulfur levels in the feed and product for various magnetic separations where liquefied coal is passed through the separator at velocity (v). The separation traps solid mineral particles from the liquid coal stream. There is little, if any, dependence on the velocity in the range up to 6 cm/s and it is likely that considerably higher flow velocities could be used. The improvement obtained with the $H_2S$ treatment in the autoclave before separation is performed is clearly displayed in these plots. Note, also, the improvement in ash reduction when the flocculant was used in Runs 7 and 8 (Table 1). This plot serves to demonstrate both the improvement in sulfur removal by adjusting the FeS ratio of "pyrite" with $H_2S$ and the additional removal of non-pyrite ash minerals by using an organic flocculant.

Equivalents

Those skilled in the art will recognize, or be able to ascertain, using no more than routine experimentation, other equivalents for the specific reactants, steps and techniques described herein. For example, and without limitation, preferential heating of the coal minerals may be accomplished with laser irradiation or inductive heating or radio-frequency irradiation in place of microwave frequencies. In some applications simply heating the whole coal may be employed. Such equivalents are intended to be included within the scope of the following claims.

What is claimed is:

1. A method for treating coal which consists of organic carbonaceous material and inorganic minerals to substantially remove sulfur therefrom comprising the steps of:

(a) pulverizing the coal to liberate some of the inorganic minerals from the coal;

(b) heating the pulverized coal to convert some of the sulfur in the inorganic minerals from the pyrite form of iron sulfide to the more catalytic form of troilite or pyrrhotite;

(c) reacting the heated coal with a chemical agent containing elements which, in the presence of said catalytic forms of iron sulfide, combine with the sulfur to remove some of the sulfur from the organic material as gaseous compounds of sulfur; and (d) separating the remaining inorganic iron sulfides, now predominantly in the relatively higher magnetic form of pyrrhotite or troilite, by a magnetic separation process.

2. The method of claim 1 including the steps of treating the coal from Step (c) with a flocculating agent prior to the magnetic separation of Step (d) to associate non-pyritic minerals in the coal with the pyrrhotite or troilite forms.

3. The method of claim 1 wherein the heating in Step (b) is a preferential heating of the inorganic sulfur in the presence of a flowing gas.

4. The method of claim 1 wherein one of the elements of the chemical agent is hydrogen.

5. The method of claim 4 wherein the agent is a liquid hydrocarbon.

6. The method of claim 1 wherein the magnetic separation is a high gradient magnetic separation process.

7. The method of claim 6 wherein superconducting magnets are used in the separation process.

8. A method for treating pulverized coal to remove sulfur therefrom comprising the steps of:

(a) irradiating the pulverized coal with energy to preferentially heat the inorganic sulfur in the presence of a flowing gas to remove some of the sulfur as a gaseous compound formed by heating the inorganic sulfur and, in the process, transforming some of the inorganic sulfur from the pyrite form of iron sulfide to the more catalytic form of troilite or pyrrhotite;

(b) treating the irradiated coal with a hydrogenation agent in the presence of said catalytic forms of iron sulfide to remove sulfur from the organic coal structure as hydrogen sulfide;

(c) treating the coal from Step (b) with an organic flocculating agent to associate non-pyritic minerals in the coal with the pyrrhotite or troilite material, and (d) separating the remaining inorganic iron sulfides, now predominantly in the relatively higher magnetic form of pyrrhotite or troilite and the non-pytitic minerals associated with the pyrrhotite or troilite by a magnetic separation process.

9. The method of claim 8 wherein the flowing gas is hydrogen, carbon monoxide or argon.

10. The method of claim 8 wherein the hydrogenation agent is an alcohol.

11. The method of claim 8 wherein the preferential heating is accomplished using microwave energy.

12. A method for treating coal to remove organic and inorganic bound sulfur therefrom comprising the steps of:

(a) pulverizing the coal to liberate some of the inorganic bound sulfur from the coal;

(b) irradiating the pulverized coal with microwave energy to preferentially heat the inorganic bound sulfur in the presence of a flowing gas thereby removing some of the sulfur as a gaseous compound formed by heating the inorganic bound sulfur and, in the process, transforming some of the inorganic bound sulfur from the pyrite form of iron sulfide to the more catalytic form of troilite or pyrrhotite;

(c) reacting the irradiated coal with a chemical agent in the presence of said catalytic forms of iron sulfide to remove organic bound sulfur; and (d) separating the remaining inorganic iron sulfides, now predominantly in the relatively higher magnetic form of pyrrhotite or troilite, by a magnetic separation process.

13. The method of claim 12 including the steps of treating the coal from Step (c) with an organic flocculant prior to the magnetic separation of Step (d) to associate non-pyritic minerals in the coal with the pyrrhotite or troilite material.

14. The method of claim 13 wherein the flocculating agent is sodium heptadecyl sulphate.

15. A method of treating pulverized coal to substantially remove organically and inorganically, bound sulfur therefrom, comprising the steps of:

(a) irradiating the coal with microwave energy in the presence of a flowing gas to preferentially heat the inorganically bound sulfur in the coal and thereby liberate some of the bound sulfur as gaseous compounds while converting some of the inorganically bound sulfur to the catalysts FeS and $Fe_{1-x}S$;

(b) in the presence of said catalysts, treating the remaining coal with an organic solvent to liberate the organically bound sulfur as a gaseous compound;

(c) separating the remaining inorganically bound sulfur, now predominantly in the relatively higher magnetic form of FeS and Fel−xS by magnetic separation.

16. The method of claim 15 including the step of associating the non-pyritic minerals in the coal with the FeS and $Fe_{1-x}S$, using a flocculating agent.

* * * * *

UNITED STATES PATENT AND TRADEMARK OFFICE

CERTIFICATE OF CORRECTION

PATENT NO. : 4,678,478

DATED : July 7, 1987

INVENTOR(S) : David R. Kelland

It is certified that error appears in the above-identified patent and that said Letters Patent is hereby corrected as shown below:

Column 8, line 56, "pytitic" should read -- pyritic --.

Column 10, line 17, "Fel-xS" should read --$Fe_{1-x}S$ --.

Signed and Sealed this

Twenty-fourth Day of November, 1987

*Attest:*

DONALD J. QUIGG

*Attesting Officer*

*Commissioner of Patents and Trademarks*